United States Patent [19]

Hight et al.

[11] Patent Number: 4,866,952

[45] Date of Patent: Sep. 19, 1989

[54] PENDANT CONTAINER FOR TABLETS AND CAPSULES

[76] Inventors: Michael D. Hight; Margaret D. Waugh, both of Suite 3, 127 Collingwood Street, Hamilton, New Zealand

[21] Appl. No.: 928,266

[22] Filed: Nov. 6, 1986

[30] Foreign Application Priority Data

Nov. 13, 1985 [NZ] New Zealand ..... 214181

[51] Int. Cl.[4] ..... A44C 15/00; A44C 25/00; A45C 11/00; B65D 83/04

[52] U.S. Cl. ..... 63/18; 206/37; 206/540; 63/2; 220/358; 215/355

[58] Field of Search ..... 63/23, 18, 19, 2; 215/DIG. 3, 355; 220/308, 310, 358; 206/535, 528, 540

[56] References Cited

U.S. PATENT DOCUMENTS

| | | | |
|---|---|---|---|
| 316,118 | 4/1885 | Cooke | 63/18 |
| 668,501 | 2/1901 | Davis | 215/355 |
| 1,095,829 | 5/1914 | Dunlap | 63/23 |
| 1,486,178 | 3/1924 | Antelmi | 63/1 R |
| 2,404,409 | 7/1946 | Smith | 215/355 |
| 2,701.659 | 2/1955 | Baltosser | 220/358 |
| 3,281,002 | 10/1966 | Geiss | 215/355 |
| 3,405,832 | 10/1968 | Lukesch | 215/355 |
| 4,420,076 | 12/1983 | Beveridge | 206/528 |

FOREIGN PATENT DOCUMENTS

| | | | |
|---|---|---|---|
| 3323159 | 1/1985 | Fed. Rep. of Germany | 215/355 |
| 1158278 | 7/1969 | United Kingdom | 215/355 |

*Primary Examiner*—Richard J. Johnson

[57] ABSTRACT

A container for medications and the like is formed of two interfitting halves which are held together in gas-tight relation by a resiliently flexible seal, the resiliently flexible seal permitting ready separation of the container halves by an incapacitated person.

4 Claims, 1 Drawing Sheet

PENDANT CONTAINER FOR TABLETS AND CAPSULES

FIELD OF THE INVENTION

This invention concerns minature containers for storing personal items such as keep sakes or medication.

BACKGROUND OF THE INVENTION

Persons who suffer ailments which must be relieved rapidly by administration of the appropriate medication for example people with coronary complaints, diabetes, asthma and allergies perfer to carry medication with them at all times. This poses problems as the cylindrical platic containers distributed by the pharmaceutical companies are bulky and usually have threaded lips which are not air tight moreover if the medication is a lactose base soft tablet, the tablets rattle and eventually erode to powder. The ingres of moisture gradually swells the tablet base and sometimes hydrolyses the drug. Coronary patients who take nitroglycerine preparations have special difficulties. They require a container which is small in relation to the tablets, patch or paste which they use, which is gas tight in order to contain the small vapour pressure of the particular presentation they use and waterproof so that they can shower, bathe or feel gradually unconcerned about the safety of the medication. One form of container already available, resembles a pressed metal make-up compact with a hinged lid. This is intended to be carried in the pocket, handbag or purse and is merely a better looking substitute for the whole plastic tablet container supplied by the pharmaceutical companies without the protection of the screw thread closure.

The opening and closing of the container must require only the simplest of movements as many intended users are aged and have impaired dexterity and poor finger pressure. Some in addition have poor eyesight.

SUMMARY OF THE INVENTION

This invention provides a gas-tight container intended for the personal storage inter alia of medication comprising:

a. a pair of co-axially overlapping shells which together define a hollow chamber, both of which have an open end and a closed end, and b. a ring seal location on one of the shells around the open end which creates a push fit, gas-tight seal between the open ends.

One of the shells may have a shoulder surrounding the open end thereof which acts to limit the extent of co-axial over lap. The seal may be a separable, resilient O-ring made of neoprene or the like. The surface of the hollow chamber may be coated to present a chemically inert surface to the contents. This may be a metal plating layer for example nickel or silver or a suitably impervious material such as enamel. Preferably the shells are made of metal and the coating is electrolytically deposited. Normally the container will be worn as a pendant and therefore one of the shells may have an eye for the reception of a necklace.

DESCRIPTION OF THE EMBODIMENTS

Figure 1:
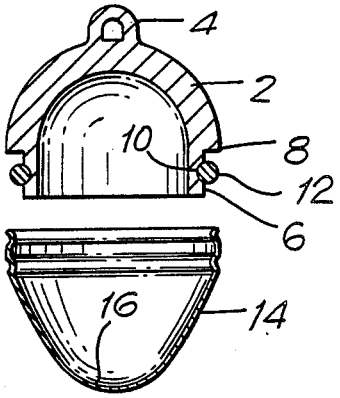
FIG. 1: is a vertical section of a container.

Referring firstly to FIG. 1, the container consists of a hemispherical top 2 which is a die casting of brass about 1.0 mm thick with an eye 4 through which a necklace chain may be threaded. The top has a rebated mouth 6 and the rebate creates a circumferential shoulder 8. The mouth 6 has a groove 10 which locates a rubber O-ring 12. The bottom part is a semi-capsule shaped shell 14 drawn from a bass blank, the inside of which has an electrolytic plated layer of nickel 16. The shell is 0.3 mm thick. The container when assembled is about the size of an acorn and the surface finish given to the container is such as to resemble an acorn.

Figure 2:
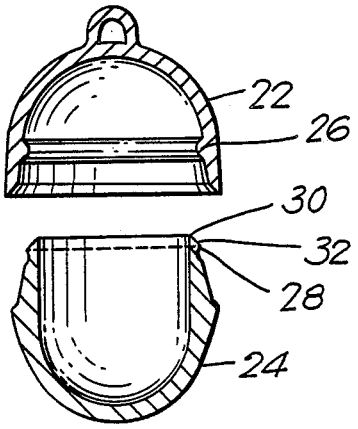
FIG. 2: is a vertical section of an alternative version of the container.

In FIG. 2 the container consists instead of a pair of polyethylene moundings 22, 24 both of equal wall thickness. The top moulding has an integral, circumferential bead 26 which is inward facing. The bottom moulding 24 has a corresponding, outwardly facing groove 28 protected by a lip 30 and a bevel 32. The bevel acts as a ramp face allowing the easier overlapping of the two halves. This version relies on a firm snap fit and needs accurate moulding in order to produce a gas tight seal. In non-illustrated versions the shells are flattened or provided with concave or concave areas, knurling or the like to improve grip.

We have found the advantages of the above described first embodiment to be:

1. The seal can be made and broken constantly without detriment to its gas-tight action and easily renewed if damaged.

2. The halves ar consequently held together by the tendency to create a partial vacuum when ever the halves are pulled apart.

3. The container may be disguised as an item of personal jewellery, its true purpose being unobvious to the onlooker.

We claim:

1. A gas-tight container generally in the form of a spheroid adapted to be worn as a locket on a person's body, and for use in the storage of a medication, comprising:

a first hollow shell member having an eyelet for the reception of a neck chain providing substantially one-half of said spheroid, and having an axially extending ring-shaped portion;

a second hollow shell member of an external shape generally similar to that of said first shell member and comprising the other half of said spheroid, said second shell member having an axially extending ring-shaped portion;

said ring-shaped portion of one of said first and second shell members being a telescopic fit within said ring-shaped portion of the other of said shell members;

sealing and securing means associated with juxtaposed axially extending faces of said respective axially extending riing-shaped portions, and which provides a sealing and securing gas-tight interference fit between said axially extending faces to locate said first and second shell members against displacement relative to each other in a manner permitting ready intentional displacement of said shell members relative to each other to permit removal of one of said shell members;

said sealing and securing means including a continuous radial projection associated with one of said axially extending ring-shaped portions which is receivable in an annular groove in the other of said axially extending ring-shaped portions, said other ring-shaped portion having a rounded shoulder at the entrance thereto for guiding said ring-shaped portions into interlocking engagement.

2. The container of claim 1, in which said sealing and securing means is provided by an O-ring positionally located in a groove in one of said ring-shaped portions, and which is an interference fit within a groove in the other of said ring-shaped portions.

3. The container of claim 2, in which the outermost one of said ring-shaped portions is provided interiorly with a groove for the reception of an outermost portion of said O-ring, and, said O-ring is positionally located in a groove provided in the innermost one of said ring-shaped portions.

4. The container of claim 1, in which said sealing and securing means is provided by a radially inwardly extending bead on an inner surface of the outermost one of said ring-shaped portions, said bead being receivable within an outwardly presented groove in the innermost one of said ring-shaped portions, at least one of said shell members being formed from a resilient material and being sufficiently deformable to permit engagement of said bead within said groove.

* * * * *